US005586917A

United States Patent [19]

Yagi et al.

[11] Patent Number: 5,586,917

[45] Date of Patent: Dec. 24, 1996

[54] CONNECTOR HAVING AN ASCERTAINMENT HOLE FOR VISUALLY CHECKING ENGAGEMENT

[75] Inventors: Sakai Yagi; Tamio Watanabe; Toru Nagano, all of Shizuoka, Japan

[73] Assignee: Yazaki Corporation, Tokyo, Japan

[21] Appl. No.: 405,855

[22] Filed: Mar. 17, 1995

[30] Foreign Application Priority Data

Mar. 17, 1994 [JP] Japan ..... 6-047156

[51] Int. Cl.[6] ..... H01R 13/514

[52] U.S. Cl. ..... 439/752; 439/910; 439/488

[58] Field of Search ..... 439/752, 488, 439/491, 910

[56] References Cited

U.S. PATENT DOCUMENTS

| | | | |
|---|---|---|---|
| 3,229,242 | 1/1966 | Finney et al. | 439/910 |
| 4,804,341 | 2/1989 | Kato et al. | 439/733 |
| 4,820,193 | 4/1989 | Noorily | 439/488 |

FOREIGN PATENT DOCUMENTS 62-188186 8/1987 Japan .

*Primary Examiner*—Gary F. Paumen
*Assistant Examiner*—T. C. Patel
*Attorney, Agent, or Firm*—Sughrue, Mion, Zinn, Macpeak & Seas

[57] ABSTRACT

A connector in which double engagement can be easily and positively verified even if an engagement pin has been damaged while being inserted into an engagement pin hole in a housing of the connector. The connector has an insertion engaging device provided with engaging pins for double engagement of a plurality of female terminals accommodated in terminal accommodating chambers which are longitudinally and laterally arranged in a connector housing. The insertion engaging device is provided on one outer peripheral surface of the connector housing, and the connector housing includes ascertainment holes penetrating through positions where fore ends of the engagement pins normally inserted into the engagement pin insertion holes are placed so that the presence of the fore ends of the engagement pins inserted into the engagement pin holes can be visually ascertained.

4 Claims, 4 Drawing Sheets

CONNECTOR HAVING AN ASCERTAINMENT HOLE FOR VISUALLY CHECKING ENGAGEMENT

BACKGROUND OF THE INVENTION

1. Field of the Invention

The present invention relates to a connector, and more particularly to a connector in which double engagement is accomplished by first and second engagement means. The first engagement means is integrally formed in a connector housing, and terminals are inserted into terminal accommodation chambers provided longitudinally and laterally in the connector housing. The second engagement means is attached to the connector housing on an outer peripheral surface of the connector housing.

2. Description of the Related Art

Conventionally, a wire harness used for the electrical circuit of an automobile is connected with various electrical equipment through the engagement of male and female connectors. For example, in an instrument panel on which a large number of switches and meters are concentrated, a plurality of connectors are necessary. Thus, it takes much time and labor to accomplish the connection of the connectors, and the connectors occupy relatively large spaces. In order to solve the above problems, a compound type connector is used, in which a plurality of connectors, the sizes and shapes of which are different, are integrated into one body so that a large number of electrical connectors can be connected using one connector.

FIGS. 4 to 7 are views showing a compound type connector of the prior art (disclosed in Japanese Unexamined Patent Publication No. 62-188186).

As illustrated in FIG. 4, in this compound type connector, a male type connector housing 1 and a female type connector housing 2 are engaged with each other to electrically connect the terminals accommodated and held in the connector housings 1, 2.

In these connector housings 1, 2, terminal accommodation chambers 8, 9 for accommodating two types of female terminals 3, 4 and terminal accommodation chambers 10, 11 for accommodating male terminals 5, 6 corresponding to these female terminals 3, 4 are longitudinally and laterally provided.

In these male and female connector housings 1, 2, a large number of terminals are accommodated, so that a relatively large force is required for the connection of the connector housings. Thus, the engagement and connection of the connector housings 1, 2 are carried out in the following manner:

A fastening bolt (not shown) is arranged so as to penetrate through a bolt attachment section provided in the same direction as that of the terminal accommodation chambers 10, 11. Corresponding to the fastening bolt, a female screw member (nut) 14 is provided at a center of the male connector housing 1. The fastening bolt and female screw member 14 are screwed together.

The connector housings 1, 2 are each provided with double engagement mechanisms. Since both double engagement mechanisms are substantially the same, only the double engagement mechanism of the male connector housing 1 will be described below.

The width of the female terminal 3 is narrower than that of the female terminal 4. In the case of the male type connector housing 1, the narrow female terminals 3 are inserted into the three rows of terminal accommodation chambers 8 located in the first, second and third rows with respect to the right and left edges, and the wide female terminals 4 are inserted into the 3 rows of terminal accommodation chambers 9 located at the center of the male type connector housing 1. These terminal accommodation chambers 8, 9 are formed so that the inserted terminals are arranged in different directions, for example, the base plate portions of the female terminals 3, 4 are at right angles with each other. As illustrated in FIGS. 6 and 7, in these terminal accommodation chambers 8, 9, there are provided lances 16, 17, respectively, which are first engagement means for preventing the disengagement of the terminals. This is accomplished by engaging the lances 16 and 17 with the electrical contact sections 3*a*, 4*a* of the inserted female terminals 3, 4, respectively.

On the outer peripheral surface of the male type connector housing 1, there are provided engagement pin insertion holes 19, 20 for communicating a plurality of terminal accommodation chambers arranged in the same row. These engagement pin insertion holes 19, 20 are open for each row of the terminal accommodation chambers.

The second insertion engagement means 22 is attached to these engagement pin insertion holes 19, 20. As illustrated in FIG. 5, this second insertion engagement means 22 includes: a plurality of engagement pins 23, 24 for engaging the terminals 3, 4 accommodated and held in the terminal accommodation chambers 8, 9 when the plurality of engagement pins 23, 24 are inserted into the engagement pin insertion holes 19, 20; and a connecting section 26 for connecting the base end portions of the plurality of engagement pins 23, 24, wherein the engagement pins 23, 24 are arranged at the predetermined pitches corresponding to the arrangement of the engagement pin insertion holes 19, 20 on the connector housing 1.

As illustrated in FIG. 7, when the lance 16 is engaged with a punched hole of the base plate portion of the electrical contact section 3*a* of the female terminal 3, the disconnection of the female terminal 3 inserted into the terminal accommodation chamber 8 is prevented. The lateral section of the engagement pin 23 of the second insertion engagement means 22 is lozenge-shaped. When a fore end of the engagement pin 23 is engaged with a step portion at the rear of the female electrical contact section 3*a* accommodated and held in the terminal accommodation chamber 8, the disconnection of the female terminal 3 engaged with the lance 16 is positively prevented in the manner of double engagement.

The lateral section of the engagement pin 24 of the second insertion engagement means 22 is formed to be rectangular, and a constricted neck portion 4*b* of the female terminal 4 is pinched by the adjacent engagement pins 24. In this way, the double engagement is realized.

To be more specific, in the connector housing 1, after the female terminals 3, 4 have been attached into the terminal accommodation chambers 8, 9, the second insertion engagements means 22 is attached through the upper and lower peripheral surfaces of the male type connector housing 1, so that the double engagement is realized with respect to the female terminals 3, 4 accommodated and held in the connector housing 1. In this way, the female terminals 3, 4 are positively prevented from disconnection.

However, in the aforementioned double engagement mechanism, the connecting section 26 of the second insertion engagement means 22 is formed to be plate-shaped, so that the connecting section 26 is relatively flexible. Therefore, when the insertion pins 23, 24 are inserted into the corresponding insertion holes 19, 20, deflection may be generated in the connecting section 26. Accordingly, it is difficult to completely insert all of the engagement pins 23, 24 into the corresponding engagement pin insertion holes 19, 20 at the same time. For example, after the operation has been completed in which the engagement pins 23, 24 of the second insertion engagement means 22 are inserted into the engagement pin insertion holes 19, 20, it is necessary to investigate whether the connecting section 26 is flush with the sides of the housing 1 in order to be able to determine whether there is complete double engagement. However, it is difficult to determine whether there is complete double engagement based only on the disposition of the connecting section 26. The reason for this difficulty is explained below.

The sectional area of the engagement pin 23 of the second insertion engagement means 22 is smaller than that of the engagement pin 24, so that deflection tends to occur in the engagement pin 23. The disposition of the connecting section 26 may not be affected if, for example, the engagement pin 23 inserted into the engagement pin insertion hole 19 is deflected or a fore end portion of the engagement pin 23 is damaged. In that case, complete double engagement can not be realized, yet it is impossible to find the problem of an incomplete double engagement because the connecting section 26 is still flush with the side of the housing 1.

BRIEF SUMMARY OF THE INVENTION

An object of the present invention is to solve the above described problems. In particular, it is an object of the present invention to provide a connector in which, when an incomplete double engagement is provided due to damage or deflection of the engagement pin inserted into the engagement pin insertion hole, the problem can be easily and positively identified, so that all of the terminals are positively put into a condition of double engagement.

The above object of the present invention can be accomplished by a connector in which it is possible to ascertain double engagement, the connector comprising: a connector housing having a first engagement means for engaging longitudinally and laterally arranged terminal accommodation chambers with terminals inserted into the terminal chambers; and a second insertion engagement means for engaging the terminals when the second insertion engagement means is inserted into the connector housing from the outside, wherein an engagement pin insertion hole for communicating a plurality of terminal accommodation chambers aligned in the same direction is open for each row of terminal accommodation chambers on one outer peripheral surface of the connector housing, the second insertion engagement means includes a plurality of engagement pins for engaging the terminals in the terminal accommodation chambers when the engagement pins are inserted into the engagement pin holes, the second insertion engagement means also includes a connecting section for connecting base end portions of the plurality of engagement pins at intervals corresponding to the arrangement of the engagement pin insertion holes formed on the connector housing, and the connector housing includes an ascertainment hole penetrating through a position where a fore end of the engagement pin normally inserted into the engagement pin insertion hole is positioned so that the fore end of each engagement pin inserted into each engagement pin hole can be visually ascertained.

When a color of the inner peripheral surface of the ascertainment hole is set to be different from a color of at least the fore end portion of the engagement pin in the above connector, the above object of the present invention can be more positively accomplished.

When the ascertainment hole is provided on an engagement surface side of the connector housing in the above connector, the above object of the present invention can be accomplished while at the same time preventing dust or other debris from entering the connector housing through the ascertainment hole.

According to the above structure of the present invention, after a terminal has been attached into each terminal accommodation chamber and engaged with the terminal accommodation chamber by the first engagement means, the second insertion engagement means is attached onto one outer peripheral surface of the connector housing. In this way, the terminal accommodated and held in each terminal accommodation chamber is subjected to double engagement. At this time, after this second insertion engagement means has been attached to the connector housing, an operator looks into the ascertainment hole provided in the connector housing, and it is thereby ascertained whether or not the fore end portion of the engagement pin of the second insertion engagement means has been inserted. In this way, an incomplete double engagement position can be easily and positively discovered. For example, in the case where an incomplete double engagement condition is provided due to damage or deflection of the engagement pin inserted into the engagement pin insertion hole of the connector housing, the problem can be easily and positively identified, so that all terminals can subsequently be put into a condition of double engagement.

In the case where a color of the fore end portion of the engagement pin inserted into the ascertainment hole is different from a color of the inner circumferential surface of the ascertainment hole, existence of the engagement pin in the ascertainment hole can be more easily verified, and the working efficiency can therefore be enhanced.

In the case where the ascertainment hole is provided on an engagement side of the connector housing, the ascertainment hole is closed when the connector housings are engaged with each other. Therefore, it is possible to prevent dust or other debris from entering the connector housing.

DETAILED DESCRIPTION OF THE PREFERRED EMBODIMENT

Figure 1:
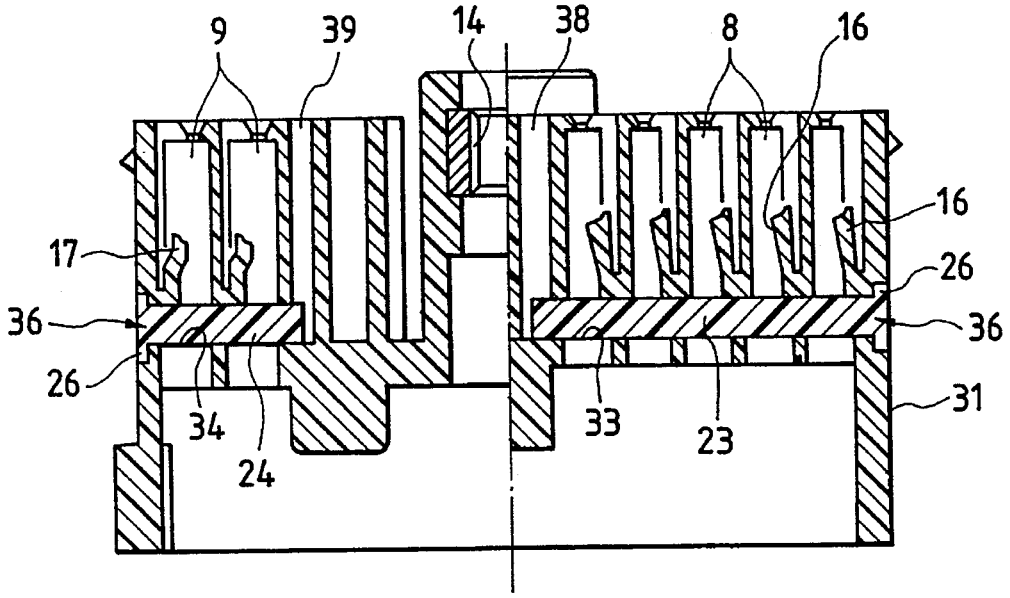
FIG. 1 is a longitudinal sectional view showing the structure of a primary portion of the example of the present invention.
Figure 3:
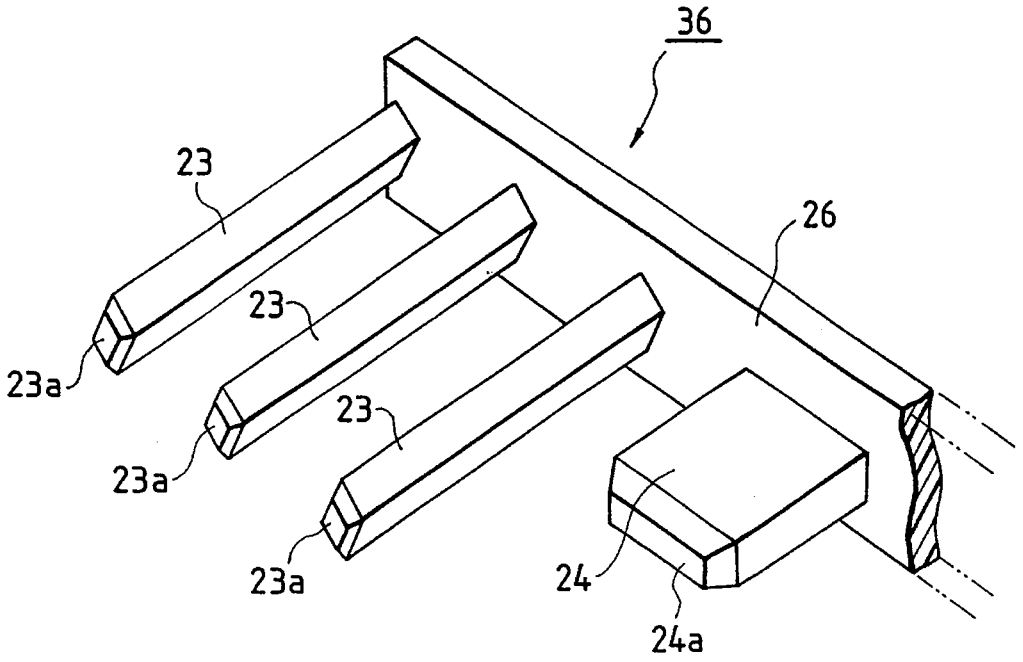
FIG. 3 is an enlarged partially perspective view of the second insertion engagement means of the example of the present invention.
Figure 2:
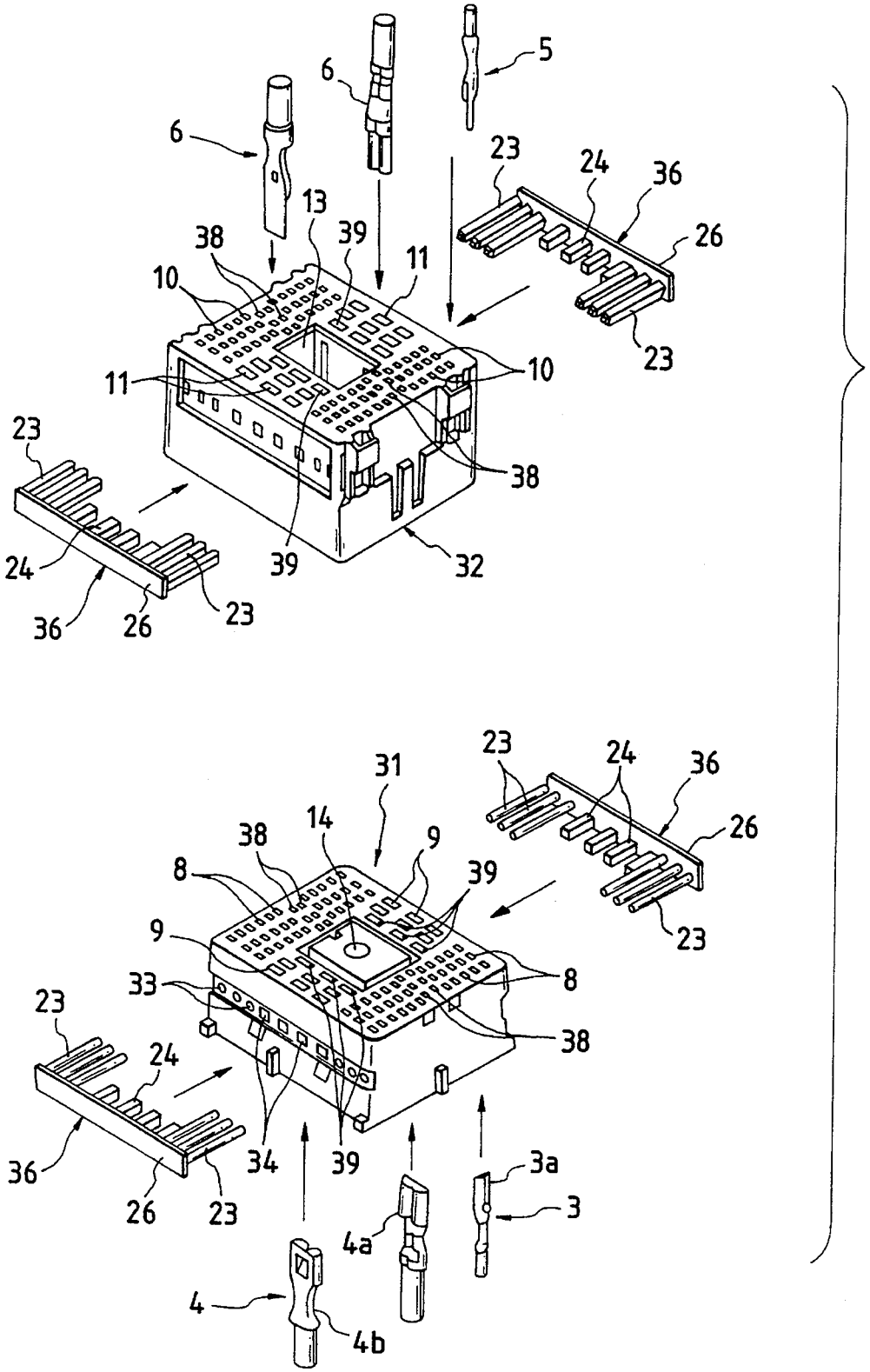
FIG. 2 is an exploded perspective view showing the overall structure of the example of the present invention.
Figure 4:
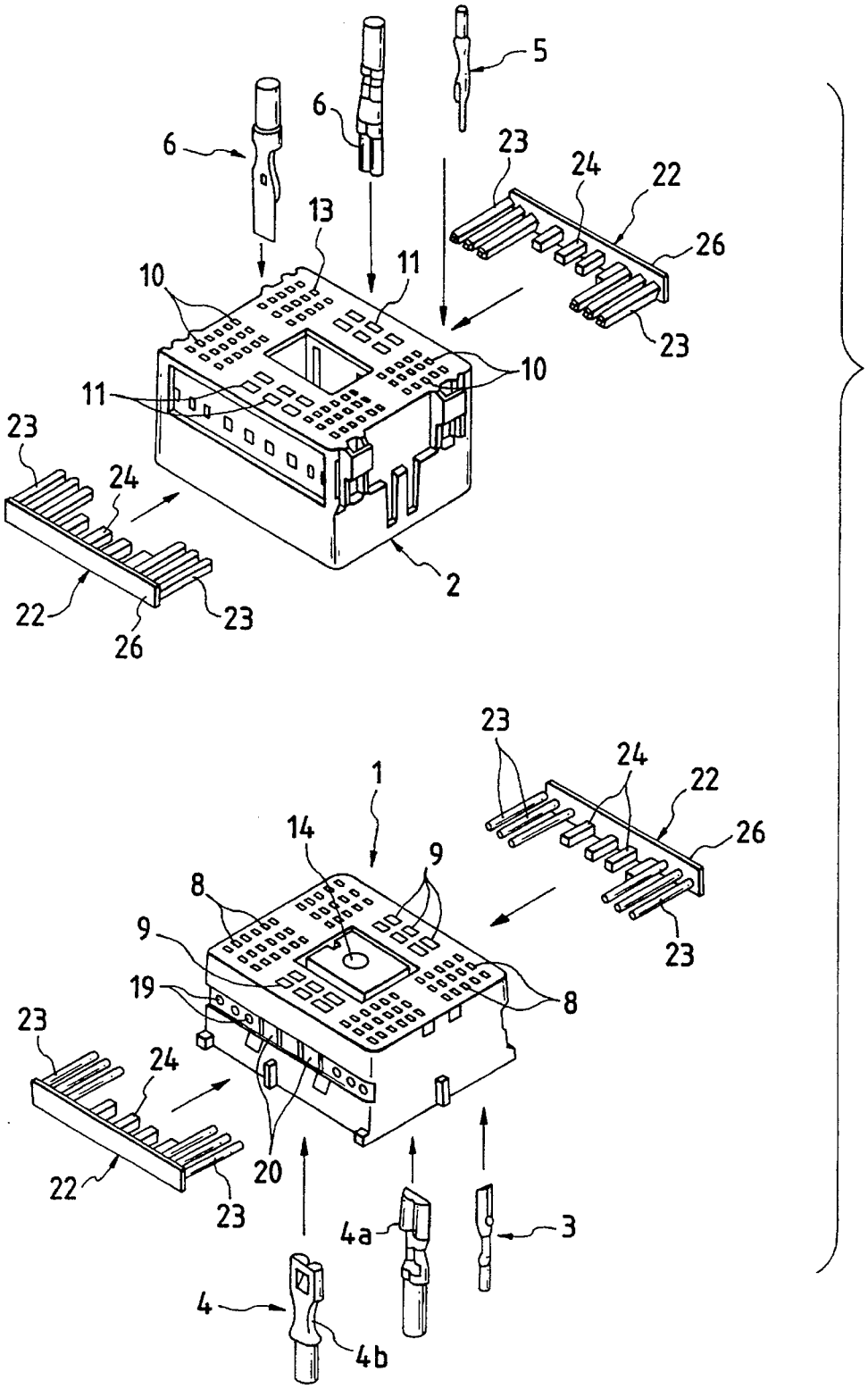
FIG. 4 PRIOR ART
FIG. 4 is an exploded perspective view showing the overall structure of a conventional connector.
Figure 5:
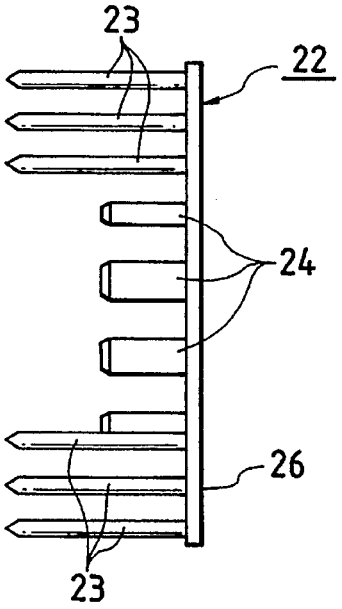
FIG. 5 PRIOR ART
FIG. 5 is a plan view of the second insertion engagement means shown in FIG. 4.
Figure 7:
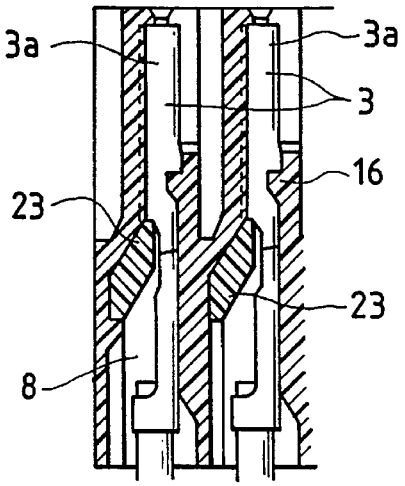
FIG. 7 PRIOR ART
FIG. 7 is a sectional view taken on line 7—7 in FIG. 6.
Figure 6:
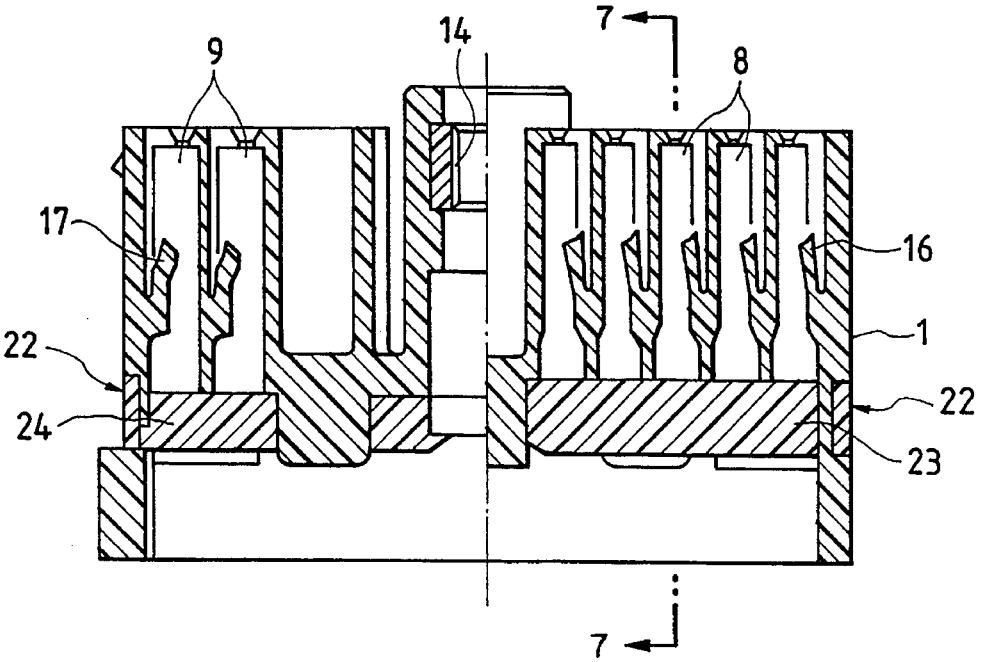
FIG. 6 PRIOR ART
FIG. 6 is a schematic illustration for explaining the engagement condition accomplished by the second insertion engagement means of a conventional connector.

FIGS. 1–3 are views showing an example of the connector making it possible to ascertain double engagement of the present invention.

This connector is an improvement over the conventional compound type connector shown in FIGS. 4–7, and thus portions of the connector of the instant invention are the same as that of the conventional connector shown in FIGS. 4–7. For example, as illustrated in FIG. 2, when the male type connector housing 31 and the female type connector housing 32 are engaged with each other, it is possible to realize the electrical connection of terminals accommodated and held in the respective connector housings.

In the connector housings 31, 32, the terminal accommodation chambers 8, 9 for accommodating the two types of female terminals 3, 4 and the terminal accommodation chambers 10, 11 for accommodating the male terminals 5, 6 corresponding to the female terminals 3, 4 are longitudinally and laterally arranged.

The engagement and connection of the connector housings 31, 32 are carried out in the following manner:

A fastening bolt (not shown) is arranged to penetrate through a bolt attachment section provided in the same direction as that of the terminal accommodation chambers 10, 11. Corresponding to the fastening bolt, a female screw member (nut) 14 is provided at a center of the male connector housing 31. These fastening bolt and female screw member 14 are screwed together to effect connection of the male and female connector housings 31, 32.

These connector housings 31, 32 are each provided with double engagement mechanisms. Since both double engagement mechanisms are substantially the same, only the double engagement mechanism of the male connector housing 31 will be described below.

The width of the female terminal 3 is narrower than that of female terminal 4. In the case of the male type connector housing 31, the narrow female terminals 3 are inserted into the three rows of terminal accommodation chambers 8 located in the first, second and third rows with respect to the right and left edges, and the wide female terminals 4 are inserted into the three rows of terminal accommodation chambers 9 located at the center of the male type connector housing 1. These terminal accommodation chambers 8, 9 are formed in such a manner that the inserted terminals are arranged in different directions, for example, the base plate portions of the female terminals 3, 4 are at right angles with each other. As illustrated in FIG. 1, in these terminal accommodation chambers 8, 9, there are provided lances 16, 17, which are the first engagement means for preventing the disengagement of the terminals by engaging with the electrical contact sections 3*a*, 4*a* of the inserted female terminals 3, 4.

On the outer peripheral surface of the male type connector housing 31, there are provided engagement pin insertion holes 33, 34 for communicating a plurality of terminal accommodation chambers arranged in the same row. These engagement pin insertion holes 33, 34 are open for each row of the terminal accommodation chambers.

The second insertion engagement means 36 is attached to these engagement pin insertion holes 33, 34. As illustrated in FIGS. 1 and 3, this second insertion engagement means 36 includes: a plurality of engagement pins 23, 24 for engaging the terminals 3, 4 accommodated and held in the terminal accommodation chambers 8, 9 when the plurality of engagement pins 23, 24 are inserted into the engagement pin insertion holes 33, 34; and a connecting section 26 for connecting the base end portions of the plurality of engagement pins 23, 24, wherein the engagement pins 23, 24 are arranged at the predetermined pitches corresponding to the arrangement of the engagement pin insertion holes 33, 34 on the connector housing 31.

As illustrated in FIG. 1, when the lance 16 is engaged with a punched hole of the base plate portion of the electrical contact section 3*a* of the female terminal 3, the disconnection of the female terminal 3 inserted in the terminal accommodation chamber 8 is prevented. As illustrated in FIG. 3, the lateral section of the engagement pin 23 of the second insertion engagement means 36 is lozenge-shaped in the same manner as that of the conventional example. When a fore end of the engagement pin 23 is engaged with a step portion at the rear of the female electrical contact section 3*a* accommodated and held in the terminal accommodation chamber 8, the disconnection of the female terminal 3 engaged with the lance 16 is positively prevented in the manner of double engagement.

As illustrated in FIG. 3, the lateral section of the engagement pin 24 of the second insertion engagement means 36 is formed to be rectangular in the same manner as that of the conventional example, and a constricted neck portion 4*b* of the female terminal 4 is pinched by the adjacent engagement pins 24. In this manner, double engagement is realized.

To be more specific, in the connector housing 31, after the female terminals 3, 4 have been attached into the terminal accommodation chambers 8, 9, the second insertion engagement means 36 is attached through the upper and lower peripheral surfaces of the male type connector housing 31, so that double engagement is effected with respect to the female terminals 3, 4 accommodated and held in the connector housing 31. In this way, the female terminals 3, 4 are positively prevented from disconnection.

In this connection, in this example, the engagement pins 23, 24 of the second insertion engagement means 36 are slightly longer than the conventional engagement pins. The engagement pins 23, 24 are slightly longer than normal so that the fore ends 23*a*, 24*a* of the engagement pins 23, 24 can be viewed from the ascertainment holes 38, 39.

As illustrated in FIGS. 1 and 2, each ascertainment hole 38 or 39 is formed for each row of a predetermined number of terminal accommodation chambers into which one engagement pin is inserted, and the ascertainment hole 38 or 39 is formed at the end of the row.

The color of the inner peripheral surface of each ascertainment hole 38, 39 is selected to be different from the color of at least the fore end portion of each engagement pin 23, 24 which is inserted into each ascertainment hole 38, 39. Consequently, the fore end portions 23*a*, 24*a* are easily discriminated.

Of course, the color of the entire connector housing 31 may be made different from the color of the entire second insertion engagement means 36.

In the connector of the example described above, the terminals 3, 4 are inserted into the terminal accommodation chambers 8, 9 of the connector housing 31. After the terminals 3, 4 are engaged with the lances 16, 17 provided in the terminal accommodation chambers, the second insertion engagement means 36 is inserted at one outer circumferential surface of the connector housing 31. Therefore, the male and female terminals 3, 4 accommodated and held in the terminal accommodating chambers 8, 9 are put into a double engagement condition. The double engagement condition is easily verified by looking through the ascertainment holes 38, 39 formed in the connector housing 31 after the attachment of the second insertion engagement means 36. The presence of the fore end portions of the engagement pins 23, 24 of the second insertion engagement means 36 in the ascertainment holes 38, 39 confirms the double engagement. Thus, when the double engagement is incomplete due to damage or deflection of the engagement pins 23, 24 inserted into the engagement insertion holes 33, 34 of the connector housing 31, the problem can be easily and positively discovered, and all terminals can subsequently be put into a double engagement condition.

Further, when colors of the fore end portions 23*a*, 24*a* of the engagement pins 23, 24 inserted in the ascertainment holes 38, 39 are different from colors of the inner circumferential surfaces of the ascertainment holes 38, 39, the presence of the engagement pins 23, 24 in the ascertainment holes 38, 39 can be more easily determined. Therefore, it is possible to increase the efficiency of ascertaining whether there is double engagement.

In this connection, in the above example, a compound type connector is shown, in which a plurality of types of terminals having different sizes and shapes are accommodated and held in one connector housing. However, it should be noted that the present invention is not limited to the compound type connector, i.e., the present invention can be applied to various multi-electrode connectors in which the terminal accommodation chambers are longitudinally and laterally arranged and the engagement pins of the second insertion engagement means are inserted from one outer circumferential surface of the connector housing.

As described above, according to the connector of the present invention, after the terminals have been inserted into the terminal chambers in the connector housing and engaged with the first engagement means provided in the terminal accommodation chamber, the second insertion engagement means is inserted at one outer circumferential surface of the connector housing. In this way, the terminals accommodated and held in the terminal accommodation chambers are secured in a double engagement condition. After the second insertion engagement means has been attached, the ascertainment hole provided in the connector housing is checked to verify whether the fore end of the engagement pin of the second insertion engagement means is present. In this way, the occurrence of an incomplete double engagement condition can be easily and positively discovered. If double engagement is not completed due to damage or deflection of the engagement pin inserted into the engagement pin insertion hole of the connector housing, the problem can be easily and positively discovered and all terminals can subsequently be positively engaged in the manner of double engagement.

Also, when a color of the fore end portion of the engagement pin in the ascertainment hole is different from a color of the inner peripheral surface of the ascertainment hole, existence of the engagement pin in the ascertainment hole is more easily verified, and the double engagement status is therefore also more easily verified.

Further, when the ascertainment hole is provided on an engagement side of the connector housing, the ascertainment hole is not exposed to the environment when the connector housings are engaged with each other. Therefore, it possible to prevent dust or other debris from entering the connector housing through the ascertainment hole. Consequently, the connector is protected and has a longer life.

What is claimed is:

1. A double engagement connector, comprising:

a connector housing comprising a plurality of longitudinally and laterally arranged terminal accommodation chambers and first engagement means for engaging a plurality of terminals inside the terminal accommodation chambers; and a second insertion engagement means for engaging the terminals when the second insertion engagement means is inserted into the connector housing, wherein said connector housing comprises at least one engagement pin insertion hole provided on an outer peripheral surface of said connector housing for communicating said plurality of terminal accommodation chambers aligned in a row, said second insertion engagement means comprising at least one engagement pin for engaging the terminals in the terminal accommodation chambers when the at least one engagement pin is inserted in the at least one engagement pin insertion hole, said second insertion engagement means also comprising a connecting section for connecting base end portions of the at least one engagement pin at intervals corresponding to an arrangement of the at least one engagement pin insertion hole, and said connector housing comprising at least one ascertainment hole penetrating through a position where an end of the at least one engagement pin inserted in the at least one engagement pin insertion hole is disposed so that the end of the at least one engagement pin can be visually observed through the at least one ascertainment hole.

2. A double engagement connector as recited in claim 1, wherein a color of an inner peripheral surface of the at least one ascertainment hole is different from a color of at least the end of the at least one engagement pin.

3. A double engagement connector as recited in claim 1, wherein a color of said connector housing is different from a color of said second insertion engagement means.

4. A double engagement connector as recited in claim 1, wherein the at least one ascertainment hole is provided on an engagement surface side of said connector housing.

* * * * *